US006612060B2

(12) United States Patent
Pearce

(10) Patent No.: US 6,612,060 B2
(45) Date of Patent: Sep. 2, 2003

(54) NON-INTEGRAL FRAME

(76) Inventor: Cameron Philip Pearce, 33591 Via De Agua, San Juan Capistrano, CA (US) 92675

( * ) Notice: Subject to any disclaimer, the term of this patent is extended or adjusted under 35 U.S.C. 154(b) by 0 days.

(21) Appl. No.: 09/858,838

(22) Filed: May 15, 2001

(65) Prior Publication Data

US 2002/0170216 A1 Nov. 21, 2002

(51) Int. Cl.[7] ..... A47G 1/08; A47G 1/16; E04C 2/54; A47F 1/14

(52) U.S. Cl. ..... 40/739; 40/741; 52/785.1; 248/467

(58) Field of Search ..... 40/597, 209, 729, 40/730, 739, 740, 741, 742; D25/119, 121, 13 C; 52/211, 204.53, 204.54, 287.1, 290, 785.1; 248/466, 467

(56) References Cited

U.S. PATENT DOCUMENTS

| | | | | | |
|---|---|---|---|---|---|
| 1,216,012 | A | * | 2/1917 | Taylor et al. | 40/739 |
| 1,598,821 | A | | 9/1926 | Holland | |
| 1,910,211 | A | * | 5/1933 | Zaiger et al. | 40/209 |
| 2,143,608 | A | | 1/1939 | Morris | |
| 2,668,477 | A | | 2/1954 | Shaikun | |
| 4,529,278 | A | | 7/1985 | Nugent | |
| 4,670,960 | A | * | 6/1987 | Provost | 24/442 |
| 4,848,542 | A | * | 7/1989 | Burnette et al. | 248/467 |
| 4,942,685 | A | | 7/1990 | Lin | |
| 5,546,687 | A | | 8/1996 | Iorfida | |
| 5,579,596 | A | * | 12/1996 | Kovacs et al. | 40/739 |
| 5,657,563 | A | | 8/1997 | Lane | |
| D398,783 | S | | 9/1998 | Plein, II | |
| 5,860,264 | A | * | 1/1999 | Gephart et al. | 52/204.71 |
| 5,971,555 | A | | 10/1999 | Wilcox et al. | |
| 6,055,757 | A | * | 5/2000 | Carlsson | 40/739 |
| 6,243,977 | B1 | * | 6/2001 | Shuen | 40/200 |
| 6,354,030 | B1 | * | 3/2002 | Harris | 40/711 |
| 6,367,182 | B1 | * | 4/2002 | Olson, Jr. | 40/593 |

FOREIGN PATENT DOCUMENTS

| | | |
|---|---|---|
| WO | WO86/04496 | 8/1986 |

* cited by examiner

*Primary Examiner*—S. Joseph Morano
*Assistant Examiner*—Jason R. Bellinger
(74) *Attorney, Agent, or Firm*—Gene Scott-Patent Law & Venture Group

(57) ABSTRACT

A non-integral frame apparatus provides, in combination, plural separate lengths of a frame structure mounted onto a mirror or similar object. Each of the lengths of the frame structure provide an outwardly facing surface with a generally decorative design, and an inwardly facing planar surface. The inwardly facing surfaces of the lengths of the frame structure provide mounting engagement devices such that the lengths of frame structure are fixed onto the mirror in an end-to-end, closed-figure arrangement without mutual engagement. This enables the mirror to appear as if framed by an integral frame assembly without suffering the drawbacks of making, handling and using such.

8 Claims, 2 Drawing Sheets

NON-INTEGRAL FRAME

BACKGROUND OF THE INVENTION

1. Field of the Invention

This invention relates generally to decorative frames and more particularly to a non-integral frame structure that has the appearance of an integral, or one piece frame.

2. Description of Related Art

The following art defines the present state of this field:

Plein, II, U.S. No. D398,783 provides for a frame for mirror.

Holland, U.S. Pat. No. 1,598,821 describes a lighting device for mirrors comprising a mirror, a frame back plate, a hollow frame secured to said back plate and surrounding said back plate, said frame being hinged to said mirror, the walls of said frame adjacent said mirror being disposed at an angle thereto and converging inwardly from their outer edges toward the mirror and having light openings formed therein, and a plurality of electric lamps mounted on the frame back plate for directing light rays through said frame openings upon a person disposed in front of a mirror, whereby the person disposed in front of a mirror, whereby the person may obtain a reflection without shadows.

Morris, U.S. Pat. No. 2,143,608 describes a frame comprising, in combination, an outer frame member and an inner frame member snugly fitting each other; the outer frame member comprising a sheet metal angle bent to shape, with one flange parallel to the general plane of the frame and the other flange at right angles to said general plane; the inner frame member comprising a sheet metal channel bent to shape, with the web thereof parallel to and spaced from that flange of the outer frame which is parallel to the general plane of the frame, when the frame members are assembled properly; one of outer frame which is parallel to the general plane of the frame, when the frame members are assembled properly; one of the flanges of the channel being in direct contact with said other flange of the angle; both flanges of the channel extending away from the flange of the outer frame which is parallel to the general plane of the frame; and means to unite the frame members.

Shaikun, U.S. Pat. No. 2,668,477 describes a stationary mirror having a flat reflecting face, said mirror having the additional function of a supporting base, a second mirror complemental to said first mirror, said second mirror being of an area appreciably less than the area of said first mirror, and means hingedly and detachably mounting one marginal edge portion of said second mirror directly on the reflecting face of the first mirror within the marginal limits of the latter mirror, said means embodying upper and lower vacuum cups detachably mounted on said reflecting face, within the stated marginal limits of said reflecting face, and pintles mounted on the respective upper and lower ends of said second mirror and having end portions assembled in the respective vacuum cups, said pintles being disposed in close spaced parallelism in respect to said reflecting surface and second mirror being consequently disposed in close spaced parallelism to said reflecting surface.

Nugent, U.S. Pat. No. 4,529,278 describes a mirror which is both easy to mount and dismount to allow for ready transfer of the mirror from place to place that is highly resistant to impact damage, so that it is safe and easy for a child to use or play with, and provides a surface for decorative or informational material. All parts are made of plastic and the mounting means consists of suction cups which are easy for a child to use in order to put up or take down the mirror. The lightness of the materials also make the mirror appropriate for use by a small child without any danger of droppage or breakage.

Lin, U.S. Pat. No. 4,942,685 describes a photo frame with a hidden light illumination loop made of light transmitting material, a DC or AC-operated light source providing necessary light delivered by the light illumination loop all around the frame and casting on the photo located within the frame. The light source is preferably made of LED bulb components. The frame includes a front cover having a central opening for the exposition of a located photograph, an intermediate light illumination loop and a supporting frame. The illumination loop is removably engaged with the supporting frame with the front cover attached to the flanges of the supporting frame and the illumination loop hidden behind the front cover without being noticed. The photo frame can be designed to have various shapes as desired.

Iorfida, U.S. Pat. No. 5,546,687 describes a transparent acrylic sheet carrying a mirrored coating on its back surface. The sheet has a ground front surface that has a layer of fluorescent paint, or, alternatively, a translucent layer of diluted fluorescent paint applied thereto. The fluorescent paint layer carries a cibachrome image transparency. Light passes through an edge of the sheet to the ground surface where it is diffused and amplified by the excitation of the fluorescent particles in the fluorescent paint. The amplified, diffused light illuminates a back surface of the transparency, thereby providing a display of an illuminated image to an observer who views a front surface of the transparency.

Lane, U.S. Pat. No. 5,657,563 describes a picture illumination display device comprising a picture frame. A one-way mirror is in the picture frame, so that when a person normally looks into the one-way mirror a reflection will be seen. A picture is carried in the picture frame behind the one-way mirror. A facility behind the picture, is for producing light. Once the light producing facility is activated an image of the picture will be projected through the one-way mirror, to allow a person looking into the one-way mirror to see the projected image from the picture.

Wilcox et al., U.S. Pat. No. 5,971,555 describes a mirror assembly comprising a U shaped perimeter frame and a planar mirror pivotally mounted to the frame. To mount the mirror assembly to the vehicle, there are a plurality of suction cups adjustably mounted at various locations along the frame so that these can be moved to the proper position. The angular position of the frame is set by means of a positioning arm pivotally connected to the frame and slide mounted to the U shaped frame. The assembly is arranged so that the mirror and the mounting arm can be moved to a collapsed position so as to lie within the plane defined by the frame.

Kitamura, WO86/04496 describes a photograph stand consisting of a photograph-holding frame, and a base having a narrow groove in which this frame is held in an upright-extended state. Light sources are provided linearly in the base, and the lower edge of the frame is positioned above these light sources. In this arrangement, the rays of light emitted from the light sources advance through the interior of the frame to be discharged from the peripheral portion thereof to the outside. Thus, and ornamental illuminator which looks as if the light is emitted from the frame itself is obtained. Moreover, the frame can be replaced by another easily, and the type of the light sources can also be changed as necessary.

The prior art teaches the use of frames, suction and adhesive attachment of frames and combinations of frames with mirrors, but does not teach a non-integral approach to achieving a framed effect with plural frame segments. The present invention fulfills these needs and provides further related advantages as described in the following summary.

SUMMARY OF THE INVENTION

The present invention teaches certain benefits in construction and use which give rise to the objectives described below.

Picture frames are broadly known and used. Such frames may be rectangular, square, round or other shapes and are generally placed to outline a work of art, mirror or other visual center of attraction. Clearly, artistic frames are used also pictorially in ads and for other commercial uses. The above prior art references teach frames that are attached to surfaces by suction cups, frames that carry lighting, designs of frames for mirrors, photo frames, and so on. The one feature in common with respect to all of these frames is that they are integral assemblies, i.e., one piece. The present invention is a non-integral frame apparatus, which comprises, in combination plural separate lengths of frame structure mounted onto an object such as a mirror, but not limited to a mirror. For instance, a work of art may be framed with the present invention. Each of the lengths of frame structure provide an outwardly facing surface, typically with a design, and an inwardly facing surface which provides a means for mounting the lengths of frame structure onto the mirror in an end-to-end, closed-figure arrangement without mutual engagement between the separate lengths. This forms the appearance of an integral frame assembly on the mirror without the drawback of assembling the lengths into an integral assembly.

A primary objective of the present invention is to provide an apparatus and method of use of such apparatus that provides advantages not taught by the prior art.

Another objective is to provide such an invention capable of compact packing, storing and shipping.

A further objective is to provide such an invention capable of simple mounting without assembly.

A still further objective is to provide such an invention capable of being used with a mirror, or where the mirror is integral to the invention to achieve a finished look without tools and conventional fasteners.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the present invention. In such drawings.

DETAILED DESCRIPTION OF THE INVENTION

The above described drawing figures illustrate the invention in at least one of its preferred embodiments, which is further defined in detail in the following description.

Figure 5:
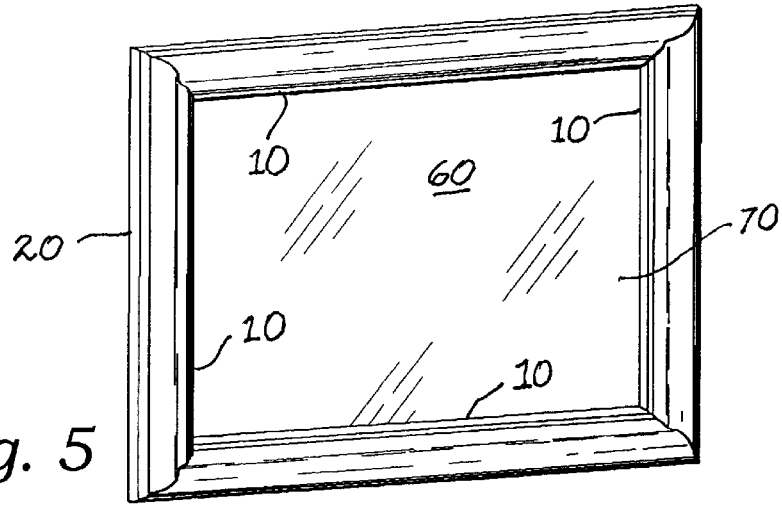
FIG. 5 is a front elevation view thereof as assembled.

The present invention is a non-integral frame apparatus which comprises, in combination, plural separate lengths, as will be generally identified by the numeral 10, of a frame structure 20 as seen in FIG. 5. Each of the lengths of frame structure 10 provide an outwardly facing surface 30 and an inwardly facing surface 40. The inwardly facing surfaces 40 of the lengths 10 of frame structure 20 provide a means for mounting, which will be represented by the numerals 50 for suction cups, 50' for Velcro® (hook and loop fasteners) and 50" for friction clamp mounting brackets. The lengths 10 are placed onto and over a mounting surface 60 in an end-to-end, closed-figure arrangement without mutual engagement. This appears, as shown in FIG. 5 to be an integral frame assembly 20.

Figure 1:
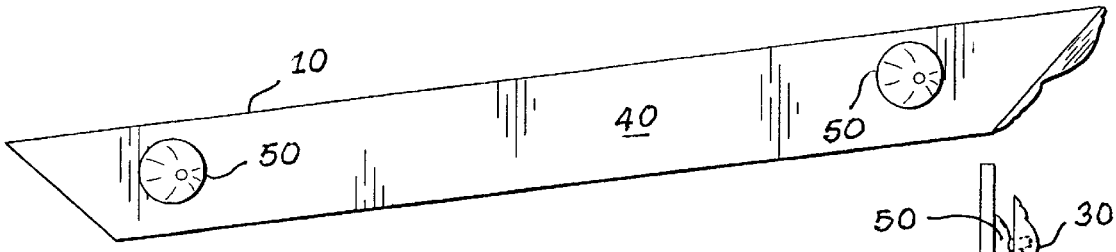
FIG. 1 is a perspective view of a rear surface of a preferred embodiment of one length of the invention.
Figure 1A:
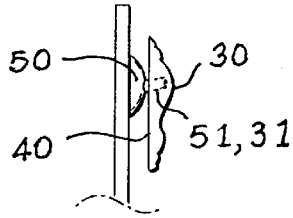
FIG. 1A is a side view thereof as applied to a mirror or similar surface.
Figure 2:
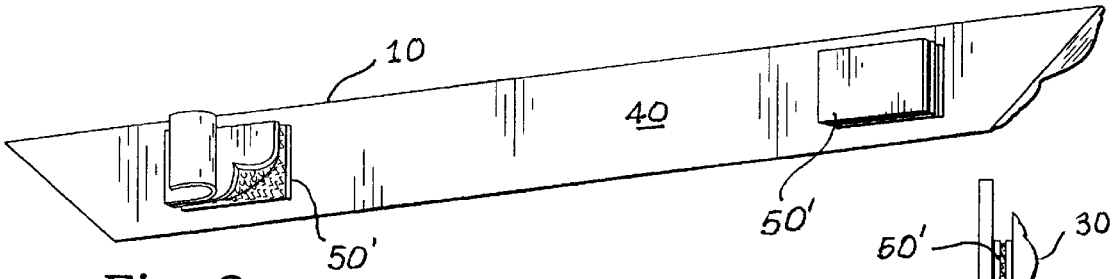
FIG. 2 is a perspective view of a rear surface of a further preferred embodiment thereof.
Figure 2A:
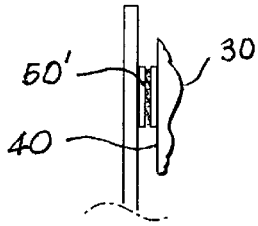
FIG. 2A is a side view thereof as applied to a mirror or similar surface.
Figure 3:
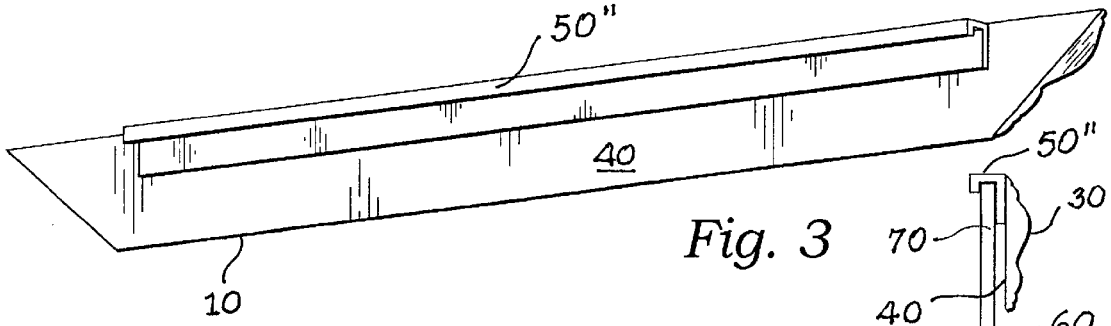
FIG. 3 is a perspective view of a rear surface of a still further preferred embodiment thereof.
Figure 3A:
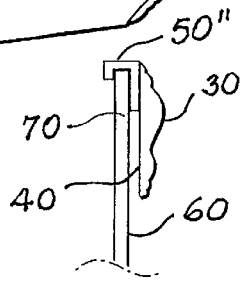
FIG. 3A is a side view thereof as applied to a mirror or similar surface.
Figure 4:
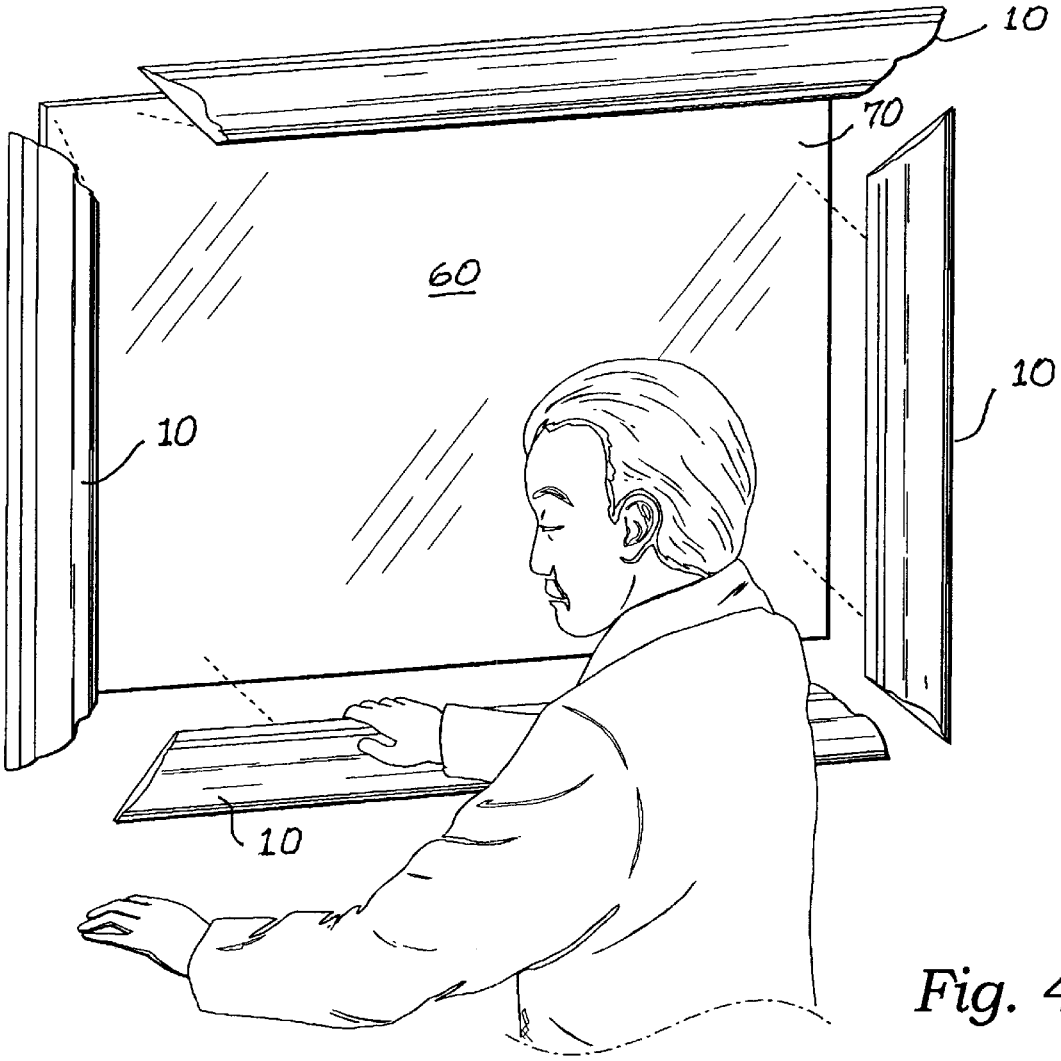
FIG. 4 is perspective view showing a method of assembly of the invention.

Clearly, the plural separate lengths 10 of the frame structure 20 may comprise four such lengths arranged as a picture frame. However, the frame structure 20 may be three or more of such lengths, and the ends of the lengths 10 may be mitered, as shown in FIGS. 4 and 5 or may be squared-off for butt laps, etc.

A primary application of the invention is for embellishing a mirror. There are many existing mirrors that could be easily improved through use of the present invention. Thus, in a further embodiment of the present invention, the non-integral frame apparatus 20 is used in combination with a mirror 70. As above, each of the lengths of frame structure 10 provide an outwardly facing surface 30 and an inwardly facing surface 40. The inwardly facing surfaces of the lengths of frame structure provide a means for mounting the lengths of frame structure onto the mirror in an end-to-end, closed-figure arrangement without mutual engagement, so as to appear to form an integral frame assembly on the mirror 70. This combination is a true reciprocal combination in that the mirror surface and its peripheral edge are ideal for the type of simple and quick mounting methods claimed, and the lengths 10 once mounted provide an improvement to the mirror in both appearance as well as functionally covering defects at or near the mirror's edge. Such defects are quite common with old mirrors where de-mirroring tends to occur at the edge.

When suction cups 50 are applied, they are preferably of the type with a plain barrel stud 51. This is a very inexpensive type and so preferable to use. The surface 40 is prepared by drilling a blind hole 31 for receiving the barrel stud 51. For improved holding of the stud 51, a rubber mounting material 32 may be poured into the hole 31 just prior to inserting the stud 51. Upon curing, the material 32 is solid yet quite resilient and does not adhere to the cup 50. The material 32 provides for an improved fit between stud 51 and hole 31 so that hole 31 need not be precision drilled, a cost saving.

When hook and loop fastener material 50' is used, one part of this two-part fastening system is adhered to each of the length 10 and the mirror surface 60. Since the two parts of the material 50' cover a local area, it is possible to move and mount the length 10 over a small range of positions in order to achieve a proper final fit with the adjacent lengths 10.

When the friction clamp mounting bracket 50" is used, it is mounted to the surface 40 by any means desired such as by bonding or screwing. The size of the space between the two legs of the bracket 50" is selected to match the thickness of the mirror 70 so that a friction mounting is possible without adhesives, bonding agents and so on.

In use, the present invention is selected to have lengths 10 of such size as to be properly fitted, as shown in FIG. 5, at the peripheral edge of the mirror 70, and also butt at the joints. The lengths 10 are pressed into place along the four edges of the mirror and butted to each other without any joining of the individual lengths 10 to each other.

While the invention has been described with reference to at least one preferred embodiment, it is to be clearly understood by those skilled in the art that the invention is not limited thereto. Rather, the scope of the invention is to be interpreted only in conjunction with the appended claims.

What is claimed is:

1. A non-integral frame apparatus which comprises, in combination: plural separate lengths of rigid frame structure; each of the lengths of frame structure providing an outwardly facing decorative surface and an inwardly facing mounting surface; and a nonmagnetic workpiece having an outwardly facing mounting surface and a peripheral edge; the inwardly facing mounting surfaces of the lengths of frame structure providing a means for mounting the lengths of frame structure onto the outwardly facing mounting surface of the workpiece without touching the peripheral edge thereof, in and end-to-end, closed-figure arrangement without mutual engagement of the lengths of frame structure, so as to appear to form an integral frame assembly around the workpiece.

2. The apparatus combination of claim 1 wherein the mounting means is plural suction cups.

3. The apparatus combination of claim 1 wherein the mounting means is plural portions of adhesively engaged hook and loop fasteners.

4. The apparatus combination of claim 1 wherein the plural separate lengths of frame structure comprise four such lengths arranged as a picture frame.

5. A non-integral frame apparatus which comprises, in combination: plural separate lengths of rigid frame structure; each of the lengths of frame structure providing an outwardly facing decorative surface and an inwardly facing mounting surface; and a glass mirror with a nonmagnetic coating, and having an outwardly facing mounting surface and a peripheral edge; the inwardly facing mounting surfaces of the lengths of frame structure providing a means for mounting the lengths of frame structure onto the outwardly facing mounting surface of the mirror without touching the peripheral edge thereof, in an end-to-end, closed-figure arrangement without mutual engagement of the lengths of frame structure, so as to appear to form an integral frame assembly around the mirror.

6. The apparatus combination of claim 5 wherein the mounting means is plural suction cups.

7. The apparatus combination of claim 5 wherein the mounting means is plural portions of adhesively engaged hook and loop fasteners.

8. The apparatus combination of claim 5 wherein the plural separate lengths of frame structure comprise four such lengths arranged as a picture frame around a periphery of the mirror.

* * * * *